United States Patent [19]

Hasulak

[11] 4,289,245

[45] Sep. 15, 1981

[54] MERCHANDISE DISPLAY STAND

[76] Inventor: Joseph Hasulak, 2932 N. 2nd St., Phoenix, Ariz. 85012

[21] Appl. No.: 971,235

[22] Filed: Dec. 20, 1978

[51] Int. Cl.[3] ..... A47F 5/05

[52] U.S. Cl. ..... 211/133; 108/101; 211/132; 248/174

[58] Field of Search ..... 211/133, 132, 167, 194, 211/205, 135, 131, 163; 248/174; 108/91, 92, 94, 101

[56] References Cited

U.S. PATENT DOCUMENTS

| | | | |
|---|---|---|---|
| 2,053,454 | 9/1936 | Whiteside | 248/174 X |
| 3,169,740 | 2/1965 | Beckett | 248/174 X |
| 3,532,310 | 10/1970 | Finfrock | 248/174 X |
| 3,889,817 | 6/1975 | Berkman | 211/163 |
| 3,920,295 | 11/1975 | Speckin | 312/108 |
| 4,082,046 | 4/1978 | Baglin | 108/101 X |

*Primary Examiner*—Roy D. Frazier

*Assistant Examiner*—Robert W. Gibson, Jr.

*Attorney, Agent, or Firm*—LaValle D. Ptak

[57] ABSTRACT

A collapsible merchandise display stand includes an elongated cylindrical center support member attached to a base. Various patterns of interlocking open-ended display boxes are formed from flat blanks of material having central, second and third spaced-apart openings in them. The central and second, and central and third, openings are each separated by a pair of spaced-apart parallel score lines. When the blanks are folded on the pairs of score lines to cause the three portions of the display member overlie one another, all three of the spaced-apart openings are in alignment to permit passage of the center post member through them to form each box of the display. Several such display boxes are stacked on the elongated center support member, and interlocking tabs and tab receiving openings on each of the display boxes are used to create various patterns, such as a spiral pattern, for the purposes of the display.

11 Claims, 10 Drawing Figures

15
16
17
18
19
20
21
22
30
31
32
33
34
35
37
38
40
A
A'

MERCHANDISE DISPLAY STAND

BACKGROUND OF THE INVENTION

Merchandise display stands are available in a wide variety of shapes, in different sizes, and made of different materials for displaying a variety of goods in a manner designed to catch the eye of shoppers passing such a stand. The object of any merchandise display stand is to display the goods attractively, so that the shoppers' attention is drawn to the goods. If the stand achieves this purpose, sales of the particular goods which are displayed on it may be greatly increased over sales which would otherwise occur if the goods were displayed in a less attractive manner.

Lighted or flashing electric signs, demonstrations, animated displays and the like also have been employed in an effort to increase the sales of various products. Demonstrations and moving exhibits, however, are relatively expensive and generally cannot be employed over a sustained period of time. Usually these are used for initial introductions or for limited-time concentrated sales promotion to increase the acceptance of a product.

Over the long term, the most effective merchandise display stand for displaying goods, either to shoppers or in trade shows, are those which confront the shopper with a large number of packages of the particular goods to be sold in a manner where those goods cannot escape the attention of even the most casual shopper or passerby. In retail stores, display stands or display areas which most effectively accomplish this purpose are often located at the ends of various rows of counters or display shelves. In the alternative, if a store has wideaisles, free-standing display bins or stack displays of the goods are often employed by locating such displays in areas which must be passed by most, if not all, of the shoppers in the store.

Often free-standing merchandise display stands or those which are located at the ends of the counters or rows of shelves in the store, are used in a particular location for a limited time. Then the display is moved to another location or is stored for a period of time until it is reused. Storage space is always scarce, so it is important that a display stand uses minimum storage space when it is not in use.

If the individual merchant is responsible for providing his own display stands, they may not be appropriate for packages of goods of different sizes or may not display some packages in the most effective manner. As a consequence, it is desirable from the manufacturer's standpoint to supply display bins, stands or display racks to display his particular goods in the most effective manner. This is commonly done. When a manufacturer, however, supplies a display from which he desires to have his goods merchandised or sold, the cost of the display necessarily must be added into the overall costs of marketing the goods. Accordingly, in order for any manufacturer to remain price competitive, the cost of additional items such as display stands and the like, should be kept as low as possible while still achieving the desired result of increasing sales of the goods.

From the merchant's standpoint, since space is always at a premium in any retail store, any display of goods of any manufacturer generally must be as limited as possible, consistent with the desires of the merchant to display and sell a wide variety of goods generally from a number of different manufacturers. Thus, if a manufacturer is going to convince a merchandiser or retailer to set up an eye-catching display of that particular manufacturer's goods, it is incumbent upon the manufacturer to accomplish his desired purposes with a minimum amount of floor space. If this can be done, his chances of gaining acceptance by merchants are much better than if a display stand or bin for those goods requires a large amount of floor or shelf space.

In an effort to meet the above requirements, a number of merchandise display stands have been developed on free standing bases and having a central pole or support member vertically extending from such base. Various compartments or shelves then are disposed about the central pole. These compartments may or may not revolve, depending upon the particular use to which the display stand is to be placed. Such stands do achieve the purpose of creating a maximum eye catching display of the goods with a minimum of space and have found wide-spread acceptance for displaying a wide variety of good. Problems still exist, however, in the cost of producing such stands and in shipping and storing them.

It is desirable to provide a merchandise display stand which occupies a minimum of space, and which is capable of displaying a large number of goods or packages of goods in an eye catching and attractive manner. It also is desirable for such a display stand to display the goods in a manner which makes them easily accessible by the shopper and from which the goods may be easily removed for examination and purchase. It also is desirable to construct the parts of such a collapsible display stand in a manner which readily is adaptable to displaying packages of goods of different sizes or which permits the display of different sizes of packages of goods in the same display. Finally, it is desirable to construct a display stand of inexpensive materials and of parts which may be shipped and stored in a form requiring very little space.

SUMMARY OF THE INVENTION

It is an object of this invention to provide an improved display stand.

It is another object of this invention to provide an improved collapsible display stand.

It is an additional object of this invention to provide an improved collapsible display stand which is made primarily of flat stock material.

It is yet another object of this invention to provide an improved collapsible display stand which may be made of lightweight fibrous material and which is capable of displaying goods in various patterns about a central vertical support.

It is a further object of this invention to provide a collapsible display stand having a central post and a number of display compartments each formed out of pieces of flat stock material which, when assembled on the central post, are interlocked with the post and with one another to form a strong display assembly for goods.

In accordance with a preferred embodiment of this invention, a merchandise display stand includes an elongated center post extending vertically from a base. A number of display compartments are formed from flat blanks of material, each having at least first and second space apart openings in them in first and second portions of the blank, respectively, for permitting passage of the post member through the opening when each of the display member blanks are bent to cause the first and second portions thereof to be spaced from and overlie one another, aligning the openings.

In a more specific embodiment, the blanks of materials are formed of fibrous material; and the portion between the first and second openings has first and second spaced apart parallel score lines located equal distances, respectively, from the centers of the openings in the first and second portion. These score lines also are perpendicular to a line passing through the centers of the first and second openings; so that upon folding of the blank on each score line at a 90 degree angle, the blank is formed into a box-like shape for displaying articles.

DETAILED DESCRIPTION

Figure 1:
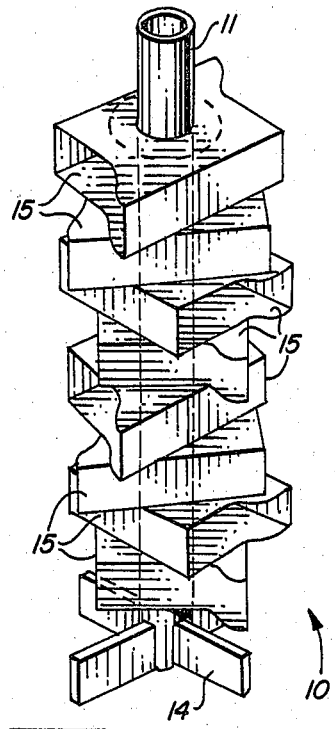
FIG. 1 shows a display stand in accordance with a preferred embodiment of the invention.

In the drawings, the same reference numbers are used throughout the several figures to designate the same or similar components. The invention illustrated in the drawings is directed to a collapsible display stand, the primary components of which may be shipped and stored flat in order to conserve space. In addition the materialsout of which the display stand is made, with the possible exception of the base, are of ordinary reinforced paperboard, cardboard, fiberboard or the like.

Figure 4:
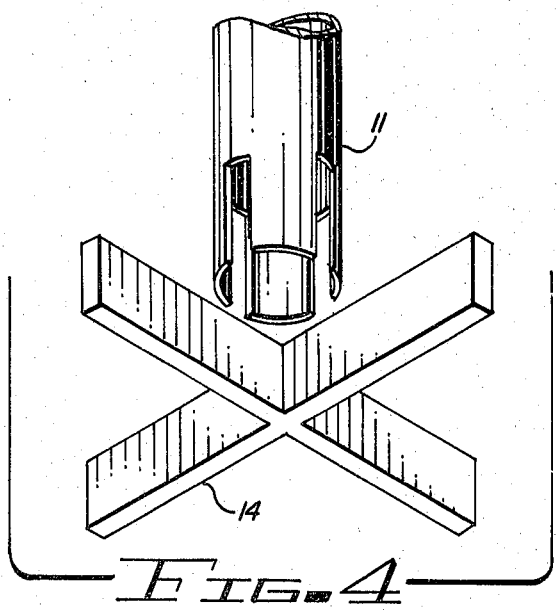

In FIG. 1, a completed display stand assembly 10 is shown. This assembly comprises a central elongated vertical support cylinder 11 which is supported on a base 14. The cylinder 11 and the manner in which it attaches to the base 14 is shown most clearly in FIG. 4. This construction permits assembly of the base and the support cylinder 11 without requiring any tools. Other assembly techniques can be employed, however, to attach the cylinder 11 to the base 14 if desired. The cylinder 11 may be made of reinforced paperboard, fiberboard or other suitable materials. These materials are ideally suited for the cylinder 11 since they are of relatively low cost and are easy to manufacture in various lengths.

Disposed about the support cylinder 11 are a number of rectangularly shaped display boxes 15, each of which are closed on four sides and open at both ends. The boxes 15 have holes formed through their centers, so that they can be slipped onto the support cylinder 11. In addition, indexing tabs and mating tab indexing holes are formed in each of the boxes 15 to permit them to be placed in a variety of angular or spiral configurations, such as the one shown in FIG. 1.

Figure 2:
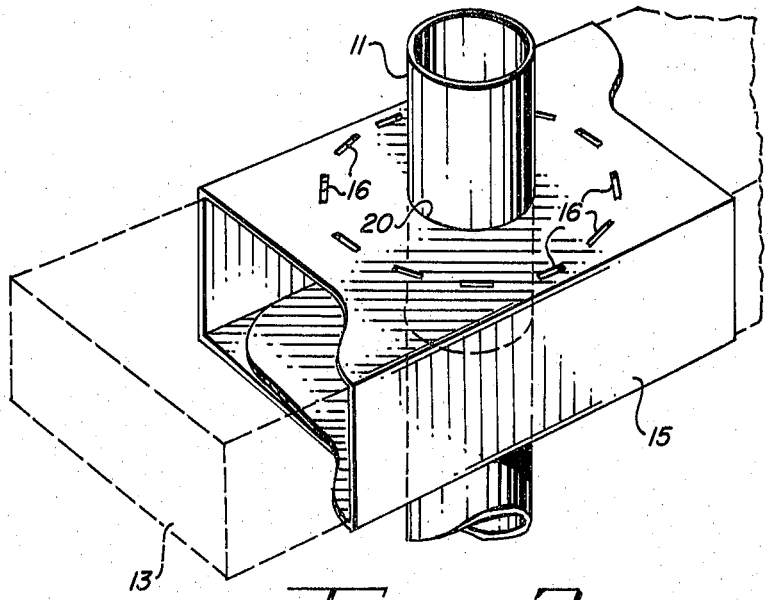
FIGS. 2, 3, 4 and 5 show details of different portions of the stand shown in FIG. 1.

FIG. 2 is a top perspective view of one of the boxes 15 showing its placement on the support cylinder 11. The top surface of the box 15 has a number of diametrically opposed pairs of slots 16 located concentrically around the center hole 20 in this surface, which places the slots 16 concentrically about the axis of the support cylinder 11. Shown in dotted lines in FIG. 2 is a representation of a rectangular box of goods 13 extending out of the display rack box 15 to the extent shown in FIG. 2. The box 13 is inserted into the open end of the display box 15 to abut against the support column 11. Thus, it is apparent from reference to FIGS. 1 and 2 that two boxes of goods 13 may be supported and displayed by each display box 15 on opposite sides of the support cylinder 11. By properly printing the trademarks, slogans and other eye catching indicia on the product box 13 itself, the display rack 10 with the products in it serves to both advertise the products and hold the products in a convenient position for removal by a shopper.

Figure 3:
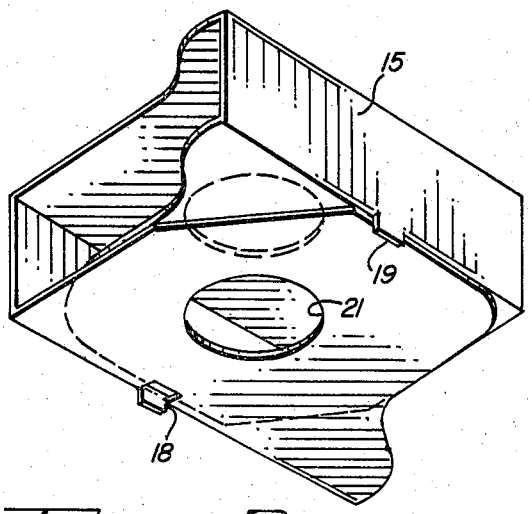

FIG. 3 is a perspective view of the underside (or topside) of the box 15 shown in FIG. 2. Two projecting locking tabs 18 and 19 extend from each of the sides of the box 15, and these tabs are located on a line passing through the center of the circular opening 21 in the bottom surface of the box 15. The tabs 18 and 19 of each box 15 engage a corresponding pair of diametrically opposed slots 16 in the next box 15 when the boxes are assembled on the support cylinder 11 as shown in FIG. 1. By providing pairs of slots 16 at various angular positions about the center of the cylinder 11, different spiral orientations of the boxes 15 relative to one another are possible depending upon the desires of the persons setting up the display.

Figure 5:
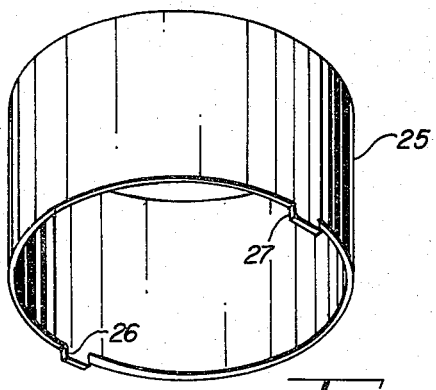

FIG. 5 illustrates a cylindrical cap or cover 25 which may be placed over the top of the support cylinder 11. This cap 25 has two downwardly projecting diametrically opposed tabs 26 and 27 which engage a corresponding pair of diametrically opposed slots 16 in the uppermost box 15 of the display rack 10 shown in FIG. 1. The cap 25 may be painted in an eye catching color or may carry desired trademarks or other indicia on it appropriate to the display with which it is used.

Figures 6, 7A, 7B, 8, 9:
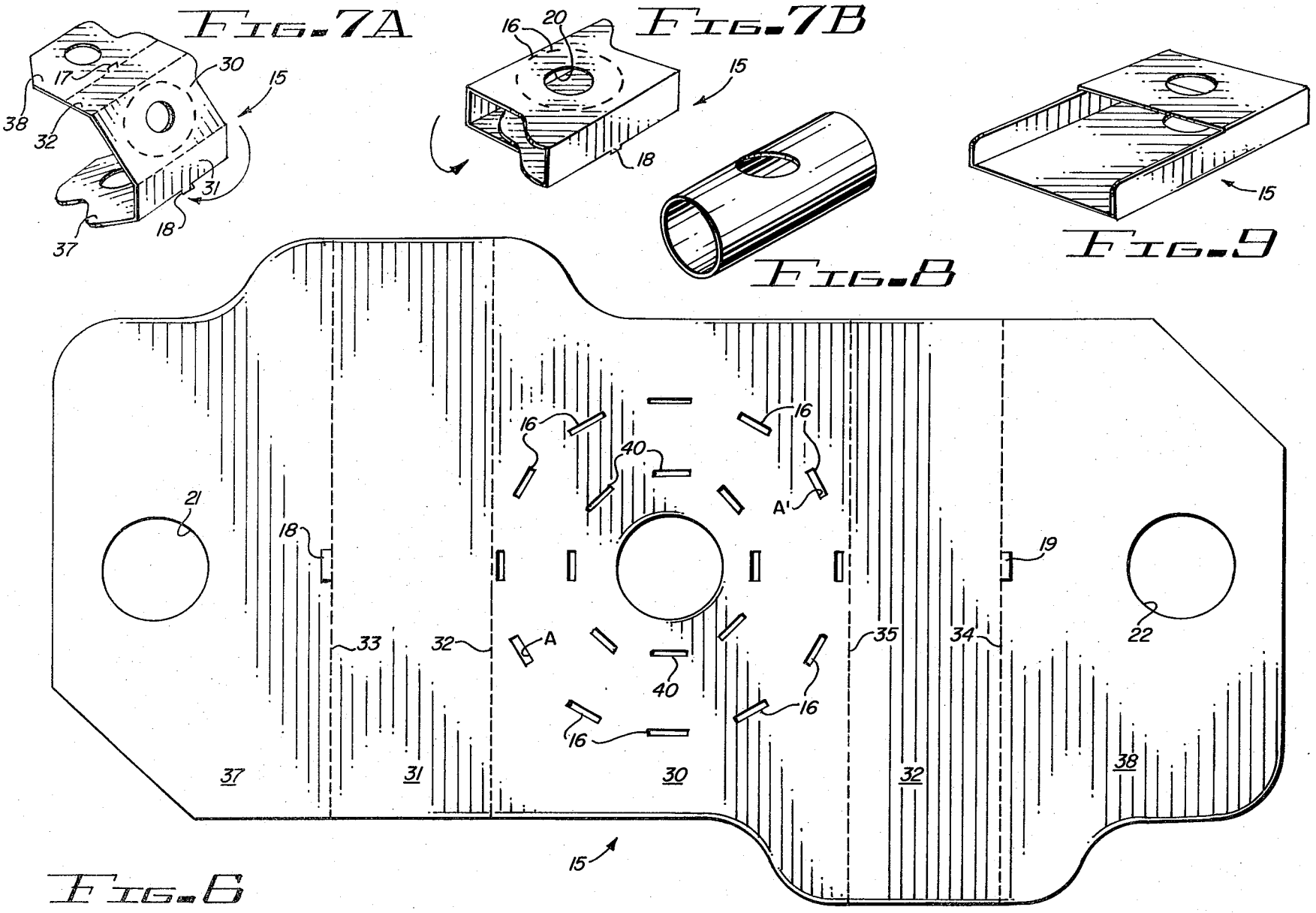
FIG. 6 show a blank used to form portions of the display stand of FIG. 1.
FIGS. 7A and 7B show the manner of folding the blank in FIG. 6 to form the subassembly shown in FIGS. 2 and 3.
FIGS. 8 and 9 illustrate other embodiments which may be used in place of the subassemblies shown in FIGS. 2, 3, 6 and 7.

Referring now to FIG. 6, there is shown a flat blank cut from reinforced paperboard, cardboard or the like used to form each of the boxes 15 shown in FIGS. 1, 2 and 3. This blank includes a central portion 30 in which the circular hole 20 is punched out or otherwise formed, along with the concentric circle of pairs of indexing tab receiving slots 16. This portion of the blank constitutes the top of the box 15, shown most clearly in FIG. 2.

On each side of this central portion 30 are a pair of side portions 31 and 32, respectively, which, in the completed assembly, form the sides of the box 15 shown in FIGS. 1, 2 and 3. These side portions 31 and 32 are delineated by pairs of parallel score lines 32, 33 and 34, 35 for the two portions 31 and 32, respectively. The distance between each of these pairs of parallel score lines is equal.

To the left of the score line 33 is a first bottom portion 37 with a circular hole 21 punched through it. To the right of the score line 34 is a similar bottom portion 38 with a circular hole 22 punched through it. The distance from the center lines of the holes 21 and 22 and the respective score lines 33 and 34 is equal. In addition, the center lines of the holes 20, 21 and 22 all lie on the same line; and this line is perpendicular to the score lines 32, 33,34 and 35. The blank shown in FIG. 6 is completed by cutting out the indexing tabs 18 and 19 from the base portions 37 and 38 respectively. These cutouts are formed on three sides as shown in FIG. 6 and the edges of the indexing tabs, 18 and 19 which lie along the score lines 33 and 34, respectively, is left intact.

To form the boxes 15 of the completed assembly shown in FIGS. 1, 2 and 3, the blank of FIG. 6 is folded along the score lines 32, 33, 34 and 35 as shown in FIGS. 7A and 7B. This causes the two bottom portions 37 and 38 to directly overlie one another. The top portion 30 overlies these portions but is spaced from them by the width of the side panel portions 31 and 32. When this is done, the indexing tabs 18 and 19 extend beyond the open-ended box 15 thus formed; so that when a number of these boxes are stacked on top of one another as shown in FIG. 1, the indexing tabs 18 and 19 may be inserted into appropriate opposing pairs of slots 16 to cause the desired spiral configuration of the various boxes 15 for the display. From reference to FIG. 6, it is apparent that each opposing pair of the slots 16, such as for example the pair A—A', are located on a diameter of the circular hole 20 in the portion 30 of the blank.

If blanks for different sizes of display boxes 15 are to be intermixed on a common central support cylinder 11, the width of the open-ended boxes 15 may vary; so that for some applications, more than one concentric circle of diametrically opposed slots may be formed into the portion 30, such as illustrated by the second circle of slots 40 in FIG. 6. The slots 40 are for a smaller box 15, formed in the same manner as the formation as the box 15 described above in conjunction with FIGS. 6, 7A and 7B. Whether all boxes of the same size are used or whether boxes 15 of different sizes are used, the slots 16 must be located the same distance from the center of the hole 20 on the lower box 15 as the distance from the fold lines 33 and 34 from the centers of the circular cutouts 21 and 22 respectively, in the bottom portions 37 and 38 of the blanks of the upper box. When this is done, the indexing tabs 18 and 19 are properly located to matingly engage corresponding opposing pairs of index tab receiving holes 16 or 40 as the case may be.

FIGS. 8 and 9 show alternative forms of completed package holding assemblies which may be formed from flat blanks of material.

FIG. 8 shows a tubular package holding assembly which is formed from a flat rectangular blank of material having three spaced apart circular cutouts formed in it similar to the spacing and location of the cutouts of the circles 20, 21 and 22 of the embodiment of FIG. 6. In forming a tubular holder of of the type shown in FIG. 8, however, no score lines are necessary since the blank merely is rolled to form the tube. It then is placed over the central supporting cylinder 11 in the same manner as the boxes 15 shown in FIG. 1. The configuration of the variation of FIG. 8 is much more limited in the type of goods which can be held and displayed in it. In addition, the various orientations which are possible with flat box-like structures such as the boxes 15 cannot be as easily accomplished through index tabs and tab receiving holes, the holder of FIG. 8, because of the lack of the score lines and the lack of a flat upper surface for receiving index tabs. If the interlocking feature which is provided by the index tabs and the tab receiving aperture described above in conjunction with the embodiments of FIGS. 1, 2, 3, 6 and 7 is not desired, however, an arrangement such as shown in FIG. 8 can be used.

FIG. 9 shows an alternative configuration which may be formed from a flat blank of material but which leaves a relatively open top side for the display of relatively wide flat boxes of goods. Obviously other variations of the shape of the boxes 15 are possible in addition to the ones which are illustrated in the preferred embodiment of FIGS. 1 through 7, and in the alternative embodiment of FIG. 9.

The foregoing description of the preferred embodiment and some alternative structures is for the purposes of illustration only, and it should be understood that variations of the invention will occur to those skilled in the art without departing from the inventive concepts which are involved. If a more open display box 15 is desired, the portions 32 and 38 of the blank of FIG. 6 could be eliminated. The box 15 then would be open on one side as well as on both ends. Of course, this also is accomplished at the expense of some structural rigidity from the structure of the embodiment described above.

I claim:

1. A merchandise display stand including, in combination:

an elongated center post member; and a plurality of display members adapted to be stacked upon one another on said post member, each of said display members formed from a flat blank of material having first, second, and third spaced-apart openings therein in first, second, and third portions thereof, said first portion being the center portion and said second portion being on one side of said center portion and said third portion being on the other side of said center portion, with said first, second, and third openings located on a common line through the centers thereof, the second and third openings being located at equal distances from the first opening, a first pair of spaced-apart parallel score lines on each of said display members between said first and second openings and a second pair of spaced-apart parallel score lines on each of said display members between said first and third openings, the distance between said first and second score lines being the same as the distance between said third and fourth score lines and all of said score lines being parallel to one another, said display member being adapted to be folded on said first and second score lines to cause said first and second portions of said display member to overly one another, and said display member being adapted to be folded on said third and fourth score lines to cause said first and third portions of said display member to overly one another with the first, second, and third openings having a common axis therethrough so that said center post member may be passed through the openings to sustain said display members for displaying articles therein.

2. The combination according to claim 1 wherein each of said display members is formed of fibrous material, said center post member is a cylindrical post member having a circular cross section, and said first, second, and third spaced apart openings in each of said display members are circular openings.

3. The combination according to claim 2 wherein said first and second spaced-apart parallel score lines are equally spaced, respectively, from said first and second openings and are perpendicular to a line passing through the centers of said first and second openings; and said third and fourth spaced-apart parallel score lines are equally spaced, respectively, from said first and third openings and are perpendicular to a line passing through the centers of said first and third openings.

4. The combination according to claim 1 wherein said first, second, third and fourth score lines are perpendicular to the line through the centers of said first, second and third openings.

5. The combination according to claim 4 wherein said first, second and third spaced apart openings are circular openings and said elongated center post member is an elongated cylinder.

6. The combination according to claim 5 further including first and second diametrically opposed tab receiving openings in the first portion of each of said display members and located on a line passing through the center of the first opening in each of said display members and tab cut-outs in said second and third portions of each of said display members on said second and fourth fold lines at a location on the line interconnecting the centers of said first, second and third openings in each of said display members and where said second and fourth fold lines are located said same predetermined distance from the center of said second and third spaced apart openings, respectively, as the distance between each of said first and second tab receiving openings, respectively, and the center of the first spaced apart opening in the first portion of each of said display members.

7. The combination according to claim 6 further including a plurality of pairs of tab receiving openings with each pair located on the circumference of a circle which is concentric with the first spaced apart opening in the first portion of said display member.

8. The combination according to claim 7 wherein the line interconnecting at least one of said pairs of tab receiving openings is other than the line passing through the centers of said first, second and third spaced apart openings in each of said display members.

9. The combination according to claim 8 wherein different pairs of said tab receiving openings are located on the circumferences of circles of different diameters concentric with the first spaced apart circular opening, with at least the tab receiving openings of one of said pairs of openings being located, respectively, on opposite sides of the center of the first spaced apart circular opening the same distance as said tabs on said second and fourth fold lines are spaced from the centers of said second and third spaced apart circular openings, respectively.

10. A merchandise display stand including, in combination:

an elongated cylindrical post member having a circular cross section; and a plurality of display members made of fibrous material and each formed from a flat blank of material having at least first and second spaced-apart circular openings therein in first and second portions thereof, respectively, and first and second spaced-apart parallel score lines on each of said display members between the first and second openings, with each of said display members being folded on said first and second score lines to cause said first and second portions of each of said display members to be spaced apart and overly one another so that said center post member may be passed through the first and second openings to sustain each of said display members for displaying articles therein; and each of said display members having at least one tab receiving opening in the first portion thereof spaced a predetermined distance from the first opening therein, and a tab cutout formed out of the second portion thereof at the second score line to project from the second score line when such display. member is folded on said first and second score lines, the location of said tab being such that it projects into the tab receiving opening of the next adjacent display member when said display members are assembled on said post member, with said post member passing through the first and second circular openings in each of said display members.

11. The combination according to claim 10 wherein said tab receiving opening is placed on the first portion of each of said display members at a point other than on the line between the centers of the first and second spaced apart circular openings in the first and second portions of each of said display members.

* * * * *